United States Patent [19]

Knak et al.

[11] Patent Number: 4,810,017

[45] Date of Patent: Mar. 7, 1989

[54] SAFETY CLUTCH

[75] Inventors: Torben Knak, Grindsted, Denmark; Naess Ludvig, Tiller, Norway

[73] Assignee: Norpol Technic A/S, Grindsted, Denmark

[21] Appl. No.: 177,934

[22] Filed: Apr. 5, 1988

[30] Foreign Application Priority Data

Apr. 10, 1987 [DK] Denmark ..... 1871/87

[51] Int. Cl.[4] ..... B63B 23/00; B66C 1/34

[52] U.S. Cl. ..... 294/82.27; 294/82.32; 294/82.34

[58] Field of Search ..... 294/82.24–82.27, 294/82.32, 82.34, 86.19, 86.29, 86.33, 90; 24/230.5 R, 241 PS, 241 SL; 114/216, 217, 249, 252, 378, 379; 279/37, 50, 57

[56] References Cited

U.S. PATENT DOCUMENTS

| | | | |
|---|---|---|---|
| 1,027,481 | 5/1912 | Huff | 294/82.27 |
| 2,941,835 | 6/1980 | Musser | 294/82.32 X |
| 3,081,122 | 3/1963 | Jungersen | 294/82.32 |
| 3,240,520 | 3/1966 | Dailey et al. | 294/82.32 X |
| 3,810,671 | 5/1974 | Jeffery | 294/82.32 X |
| 4,258,888 | 3/1981 | Sawn | 294/82.32 X |

*Primary Examiner*—Johnny D. Cherry

*Attorney, Agent, or Firm*—Banner, Birch, McKie & Beckett

[57] ABSTRACT

The safety clutch includes a first tubular part (1), a second tubular part (13) and a plurality of locking members (5) co-operating with the parts in such a manner as to establish therebetween a releasable connection. The locking members (5) have inclined abutting surfaces (11) orientated so that the engagement between the surfaces and a corresponding abutting surface (12) on the second part (13) exerts a radially outward force on the locking members (5). The force is transmitted over axially parallel locking surfaces (16) to a corresponding locking surface (19) on an encircling locking ring (18) which in the locked position of the clutch mechanically prevents the locking members (5) from disengaging the second part (13). The releasing force of the clutch is thus closely associated with the frictional force existing between the locking surface (16 and 19) and which in practice may have any desired value. A spring-biassed and axially displaceable release ring (25) for releasing the clutch is arranged around the locking ring (18). Dependent upon the allowed axial displacement of the release ring (25) it is obtained that the force transmitted to the locking ring is either equal to the force of the inserted spring or is directly equal to the force exerted on the release ring (25). This opens up the prospect of obtaining in a simple manner a safe release of the clutch in the off-load case as well as in the on-load case.

3 Claims, 1 Drawing Sheet

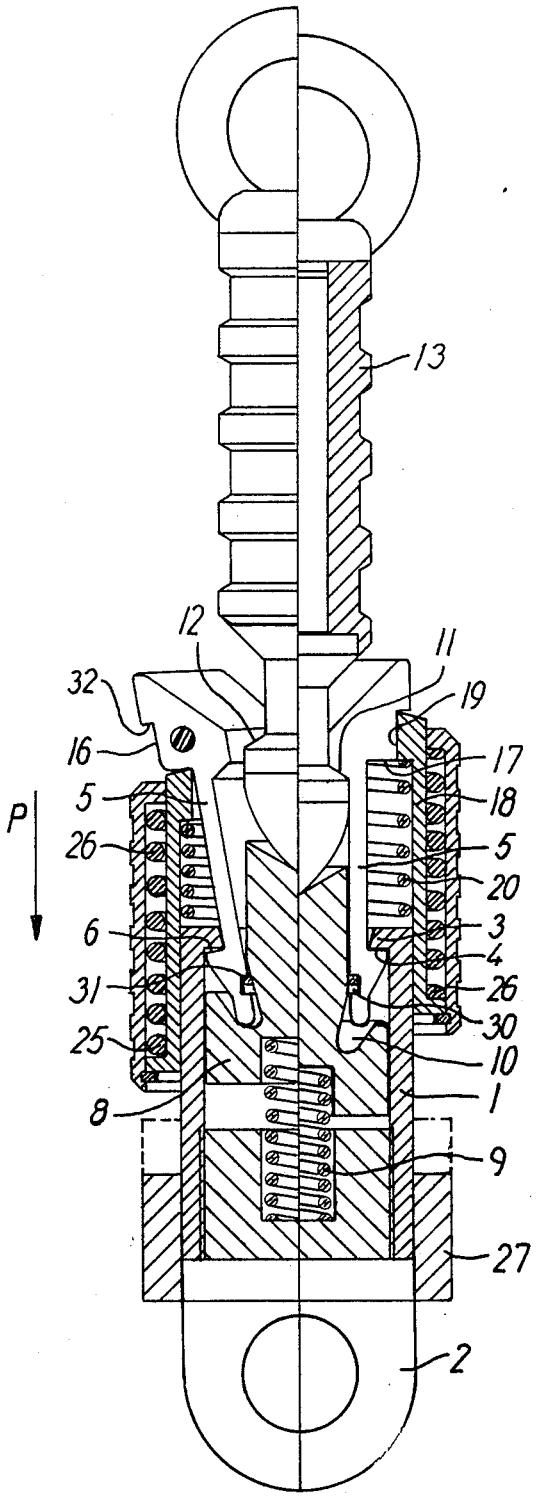
13
12
11
32
19
16
17
5
18
P
26
5
20
6
3
4
31
26
30
25
10
8
1
9
27
2

SAFETY CLUTCH

BACKGROUND OF THE INVENTION

This invention relates to a safety clutch, particularly for use in launching life floats and the like, and of the type comprising an approximately tubular first part, an approximately cylindrical second part and a plurality of locking members in engagement with said first part, said locking members having each an abutting surface adapted to engage a corresponding abutting surface on the second part, a radially external locking surface, and being altogether adapted to co-operate with said first and second part respectively, in such a manner as to establish a releasable connection therebetween.

Such safety clutches are used in maritime relations particularly in connection with lifting and lowering manned boats, for oil drilling rigs and similar off-shore structures where the distance between the working deck and the sea surface may be up to about 50 m.

Owing to the difficult conditions frequently prevailing in such circumstances, e.g. heavy sea and strong winds rigorous demands are made on such clutches.

Said demands being imposed, partly by various safety regulations and partly by the actual conditions imply inter alia that the clutch must be releasable both in the so-called off-load state, i.e. in a partially unloaded condition, and in the so-called on-load state, i.e. when fully loaded.

The off-load case that is the normal situation occurs when the boat is to be lowered onto the sea. In case of slight sea this will not cause problems while in case of more or less heavy sea the boat will "knock" against the waves for a period of time before it has been lowered sufficiently to be supported solely by the water. In order to reduce said transitional period—which involves considerable risks to equipment as well as to personnel—clutches of the present type are used which upon activation will be released the first time their load falls below a predetermined magnitude. In reality this entails that the boat descends with a wave the first time the clutch is relieved, thereby minimizing the transitional period and the risks thereby involved.

As mentioned, in the on-load case the clutch is to be released when fully loaded. This situation is in fact identical with a situation of emergency where it is crucial to quickly have the actual connection interrupted.

In a known safety clutch of the already recited type the control member is shaped as a mantle approximately U-shaped in cross-section and mounted axially displaceable around the tubular first part. The locking wedges are arranged equidistantly around the circumference of the clutch and are pivotally journalled in the mantle by means of individual pivot pins. A spring biasses the control member and thus also the locking wedges in a direction towards the locking position. The clutch is released by displacing the control member shaped as a handle against the spring action, thereby pulling the locking wedges out of engagement with the locking groove in the central second part.

Said prior clutch, however, suffers from various disadvantages and difficulties.

Firstly, this prior clutch is not prepared for on-load release. Consequently, the clutch is to be fitted with supplementary components for that purpose in case said demand—frequently obligatory—has to be complied with.

Secondly, the clutch only offers a limited possibility of reducing the above mentioned transitional period before the boat is floating, because the withdrawal of the locking wedges necessitates a force exceeding the load-dependent force exerted on the clutch proper. This means that the clutch will not disengage until the part of the force corresponding to the weight of the boat still activating the clutch is inferior to the manually exerted force which may at a maximum correspond to operator's weight. Since the total weight of the boat typically exceeds operator's weight several times, the result is that the clutch is not released until the boat by and large is floating after all, in other words, only at the end of the critical transitional period.

SUMMARY OF THE INVENTION

The safety clutch according to the invention differs from prior art clutches in that the first part includes a spring-biassed locking ring axially displaceable in relation thereto and provided with a radially internal locking surface adapted to co-operate with the external locking surfaces of the locking members, an axially displaceable release ring arranged around the locking ring and being spring-biassed in relation thereto, and a blocking member adapted to determine the possible axial displacement of the release ring, and that the co-operating abutting surfaces of the locking members and the second part are orientated so that the locking surfaces of the locking members are pressed against the corresponding locking surface of the locking ring when the clutch is loaded.

This provides for obtaining that the releasing force of the clutch is approximately equal to the total of the actual frictional force between the co-operating locking surfaces of the locking members and the locking ring and the spring force acting directly on the locking ring in relation to the first part. Said latter spring force is small and will therefore be ignored in the following.

The magnitude of the frictional force is mainly determined by the angular orientation of the load transferring abutting surfaces but due to the remainder of the structure of the clutch said force is not decisive of the locking effect proper which is effected in that the locking ring mechanically prevents the locking members from disengaging the second part.

In view of the above it is possible with a suitable orientation of the abutting surfaces to provide any desired relation between the load of the clutch and the associated releasing force, thereby ensuring the off-load release as well as the on-load release to be effected without problems and without the requirement of exertion of force of the hitherto required magnitude.

By carrying out the clutch with the release ring being spring-biassed relative to the locking ring it becomes possible to restrict the force transmitted between said rings to the force of the actual spring itself which, as will be explained in the following, is particularly advantageous when releasing the clutch in the off-load case.

BRIEF DESCRIPTION OF THE DRAWING

The invention will now be explained in detail with reference to the drawing illustrating a partially schematically composed longitudinal section through the clutch according to the invention in two different positions.

As it will appear, the right half of the drawing illustrates the clutch when locked, while the left half of the drawing illustrates the clutch when released.

DETAILED DESCRIPTION

In the illustrated embodiment the clutch includes a largely tubular first part into the one end of which an eye 2 is screwed. The other end of the first part is formed with an encircling radially inwardly directed collar having an annular, axially orientated bearing surface 4 engaging corresponding bearing surfaces 6 of four locking members 5 having approximately the shape of circular ring sectors and being uniformly distributed along the circumference. The locking members 5 are kept in place by a mushroom-shaped control slide 8 axially displaceably journalled in the first part, said control slide being spring-biassed by a spring 9 in the direction towards the inner ends of the locking members 5 accommodated within part 1. Control slide 8 is provided with an encircling groove 10 the inclined walls of which are in engagement with said ends of locking members 5, and the slide extends a distance further centrally in between locking members 5 to ensure their being correctly positioned. Close to their opposite external ends the locking members are provided with an inwardly directed abutting surface 11 adapted to abut a corresponding abutting surface 12 of a second part 13 the foremost end of which is adapted to be inserted between locking members 5. As shown, the co-operating abutting surfaces 11 and 12 have such an orientation that they bias the external ends of locking members 5 radially outwardly upon withdrawal of second part 13.

Close to their outer ends locking members 5 likewise have a radially external locking surface 16 and a shoulder surface 17 approximately perpendicular thereto.

A tubular locking ring 18 having near its free end a radially internal locking surface 19 adapted to co-operate with the external locking surfaces 16 of locking members 5 is located radially around the first part 1. Locking ring 18 is displaceable in relation to the first part 1 by means of a spring 20. A likewise tubular release ring 25 which is spring-biassed by a spring 26 and displaceable in relation to locking ring 18 is located around locking ring 18.

An annular blocking member 27 adapted to limit the axial displacement of release ring 25 in relation to locking ring 18 is provided at the eye 2 of first part 1, blocking member 27 being fixable by means, not shown, in two different positions in relation to first part 1.

The clutch operates as follows:

In the released position of the clutch—illustrated to the left in the drawing—locking ring 18 together with release ring 25 is retained against the effect of spring 20, locking ring 18 being in engagement with shoulders 17 of locking members 5. The outer ends of locking members 5 are pivoted radially outwardly so that the front rounded end of second part 13 may be inserted therebetween. Said pivoting is effected due to the fact that the inner ends of locking members 5 are in engagement with the inclined walls of groove 10 of control slide 8 and, consequentially, they are pressed radially inwardly, thereby causing locking members 5 to rotate about collar 3.

When the releasable connection is to be established the front end of second part 13 is inserted between locking members 5 to abut against control slide 8 and force this backwards against spring 9. The inner ends of the locking members are then urged radially outwardly, on one hand, owing to their geometrical engagement with part 1 and control slide 8 and, on the other hand, owing to an annular spring 31 accommodated within an internal slot 30 and which actuates the locking members radially outwardly.

After a certain pivoting of locking members 5 locking ring 18 is able to pass shoulders 17 and slide further on to locking members 5 due to spring 20 until it abuts additional shoulders 32 thereon. Simultaneously, abutting surfaces 11 and 12 on locking members 5 and second part 13, resp., are engaging while locking surfaces 16 and 19 on locking members 5 and locking ring 18, resp., are engaging. Hereafter the clutch occupies the position illustrated to the right in the drawing.

When the clutch thus locked is loaded the force transmitted over abutting surfaces 11 and 12 will, result, on one hand in an axially directed component between bearing surfaces 4 and 6 on collar 3 and locking members 5 of part 1, resp., and, on the other hand, in a radially directed component between locking surfaces 16 and 19 of locking members 5 and locking ring 18, resp. The ratio between the magnitude of said two components depends on the angular orientation of abutting surfaces 11 and 12 and it is thus possible by altering said orientation to attain any desired mutual relation between said components of force.

When the clutch is to be released in the off-load state release ring 25 is pulled in the direction of arrow P against the force of spring 26 to abut against blocking member 27. This member occupies a first position illustrated in dotted lines which just prevents release ring 25 from being displaced to such an extent that spring 26 becomes totally compressed. Consequently, the force transmitted to locking ring 18 equals the force exerted alone by spring 26.

This provides for obtaining that the clutch releases only when the load-dependent frictional force between locking surfaces 16 and 19 becomes less than the total of the force exerted by springs 20 and 26. By a suitable dimensioning of said springs in dependence on the actual conditions between locking surfaces 16 and 19 it is thus possible to adapt the releasing force of the clutch to a given situation.

When locking ring 18 during release has been pulled clear of locking surfaces 16 of locking members 5, said locking members pivot outwardly, thereby disengaging second part 13 which may now freely leave first part 1. Then, the clutch occupies the position shown on the left half of the drawing.

When the clutch is to be released in the on-load state, blocking member 27 is shifted from the first position to the illustrated second position in which release ring 25 is allowed to be axially displaced to such an extent that spring 26 may be totally compressed.

The releasing is now forcibly effected by suddenly pulling release ring 25 downwards in the direction of arrow P. This causes spring 26 to be entirely compressed, thereby delivering a sort of hammer stroke on locking ring 18. Said sudden stroke results in a force considerably higher than the total oppositely directed spring force and entails that locking ring 18 is knocked clear of locking surfaces 16 of locking members 5. Subsequently, the release of the clutch is effected as described above. After the on-load release has been accomplished blocking member 27 is returned to the off-load position, following which the clutch is ready again.

We claim:

1. A safety clutch, particularly for use in launching life floats and the like; and of the type comprising an approximately tubular first part (1), an approximately cylindrical second part (13) and a plurality of locking members (5) in engagement with said first part, said locking members having each an abutting surface (11) adapted to engage a corresponding abutting surface (12) on the second part (13), a radially external locking surface (16), and being altogether adapted to co-operate with said first and second part respectively, in such a manner as to establish a releasable connection therebetween, characterized in that the first part (1) includes a spring biassed locking ring (18) axially displaceable in relation thereto and provided with a radially internal locking surface (19) adapted to co-operate with the external locking surfaces (16) of the locking members (5), an axially displaceable release ring (25) arranged around the locking ring and being spring-biassed in relation thereto, and a blocking member (27) adapted to determine the possible axial displacement of the release ring, and that the co-operating abutting surfaces (11, 12) of the locking members and the second part are orientated so that the locking surfaces (16) of the locking members (5) are pressed against the corresponding locking surface (19) of the locking ring (1) when the clutch is loaded.

2. A safety clutch as claimed in claim 1, characterized in that each locking member (5) approximately has the shape of a circular ring sector, that the locking members 5 close to their foremost ends which is positioned within the first part (1) are provided with bearing surfaces (6) which in the locked position of the clutch are orientated approximately perpendicular to the longitudinal axis of the clutch and abut an oppositely orientated bearing surface (4) in the first part (1), and that the co-operating locking surfaces (16, 19) of the locking members and the locking ring, resp., in the locked position of the clutch extend roughly in parallel to the longitudinal axis of the clutch.

3. A safety clutch as claimed in claim 1 or 2, characterized in that a control slide (8) is accommodated within the first part (1), said slide being spring-biassed in the direction towards the foremost ends of the locking members (5) and having an encircling, inwardly facing inclined surface adapted to abut said foremost ends of the locking members (5) and affect them radially inwardly, thereby simultaneously biassing the outer ends of the locking members radially outwardly.

* * * * *